US009782991B2

(12) United States Patent
Chiba et al.

(10) Patent No.: US 9,782,991 B2
(45) Date of Patent: Oct. 10, 2017

(54) PRINTER

(71) Applicant: FUJITSU COMPONENT LIMITED, Tokyo (JP)

(72) Inventors: Masafumi Chiba, Tokyo (JP); Sumio Watanabe, Tokyo (JP); Yoshinari Takabatake, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/326,757

(22) PCT Filed: Jul. 22, 2015

(86) PCT No.: PCT/JP2015/070805
§ 371 (c)(1),
(2) Date: Jan. 17, 2017

(87) PCT Pub. No.: WO2016/013569
PCT Pub. Date: Jan. 28, 2016

(65) Prior Publication Data

US 2017/0210154 A1 Jul. 27, 2017

(30) Foreign Application Priority Data

Jul. 23, 2014 (JP) ..... 2014-149903
Aug. 1, 2014 (JP) ..... 2014-158038

(51) Int. Cl.
*B41J 29/13* (2006.01)
*B41J 29/02* (2006.01)

(52) U.S. Cl.
CPC ..... *B41J 29/02* (2013.01); *B41J 29/13* (2013.01)

(58) Field of Classification Search
CPC . B41J 29/00; B41J 29/02; B41J 29/023; B41J 29/026; B41J 29/13; B41J 15/044; B41J 3/4075; B41J 32/00
See application file for complete search history.

(56) References Cited

U.S. PATENT DOCUMENTS 6,744,457 B2 6/2004 Seino et al.
2008/0068437 A1 3/2008 Hirai

FOREIGN PATENT DOCUMENTS

JP H02-160558 6/1990
JP H07-068866 3/1995
JP 2003-246104 9/2003
JP 2008-068552 3/2008

*Primary Examiner* — Kristal Feggins
(74) *Attorney, Agent, or Firm* — IPUSA, PLLC

(57) ABSTRACT

A printer includes a printer body, a lid, a lock, a lock lever, and an open lever. The lid is attached to the printer body to be opened and closed. The lock locks a platen roller attached to one of the printer body and the lid. The lock lever unlocks the locked platen roller. The open lever is so provided on the lid as to slide. The open lever slides to press the lock lever to open the lid.

7 Claims, 28 Drawing Sheets

PRINTER

TECHNICAL FIELD

The present invention relates to printers.

BACKGROUND ART

Printers are widely used for shop registers and automated teller machines (ATMs) or cash dispensers (CDs) in banks. Printers that output receipts perform printing on recording paper with a head while conveying the recording paper, and after conveying the recording paper to a predetermined length, cuts the recording paper with a cutter. The cutter includes a fixed blade and a movable blade, and the movable blade slides toward the fixed blade to cut the recording paper between the fixed blade and the movable blade.

Furthermore, printers that include a printer body and a lid pivotably supported on the printer body to be opened to allow a roll of recording paper to be loaded in the printer body are known. In this case, for example, a head is provided in the printer body, and a platen roller is provided on the lid. By closing the lid, the recording paper is held between the head and the platen roller. Printing is performed on the recording paper with the head with the recording paper held between the head and the platen roller. The lid is provided with a lid opening lever for opening and closing the lid, and the lid can be opened by operating the lid opening lever.

PRIOR ART DOCUMENTS

Patent Documents

[Patent Document 1] Japanese Patent No. 2585769
[Patent Document 2] Japanese Laid-Open Patent
[Patent Document 3] Japanese Laid-Open Patent Application No. 2003-246104

SUMMARY OF THE INVENTION

Problems to be Solved by the Invention

According to the above-described printers, the lid, which is opened and closed at the time of loading a roll of recording paper, is provided with a spring that urges the lid in a direction to open at the connection between the printer body and the lid for a smooth opening operation of the lid.

There is, however, a general demand for low-cost printers, and printers reduced in the number of components without a spring or the like are preferred.

Furthermore, when cutting recording paper, the movable blade slides toward the fixed blade to cut the recording paper, but if the recording paper is held between the fixed blade and the movable blade sliding toward the fixed blade, the recording paper stuck between the fixed blade and the movable blade may prevent the movable blade from moving, thus preventing the movable blade from returning to its original state. In this state, the immobilized movable blade hinders the lid from being opened.

Means for Solving the Problems

According to an aspect of the present invention, a printer includes a printer body, a lid, a lock, a lock lever, and an open lever. The lid is attached to the printer body to be opened and closed. The lock locks a platen roller attached to one of the printer body and the lid. The lock lever unlocks the locked platen roller. The open lever is so provided on the lid as to slide. The open lever slides to press the lock lever to open the lid.

According to an aspect of the present invention, a printer includes a printer body, a lid, a lock lever, and an open lever. The lid is attached to the printer body to be opened and closed. The lock lever separates a platen roller attached to one of the lid and the printer body and a recording head attached to the other of the lid and the printer body. The lock lever is provided in the printer body. The open lever is slidably attached to the lid and slides to operate the lock lever. The open lever is removable from the lid.

According to an aspect of the present invention, a printer includes a printer body, a lid, a lock lever, and an open lever. The lid is attached to the printer body to be opened and closed. The lock lever locks the lid to the printer body. The open lever is slidably attached to the lid and slides to operate the lock lever to unlock the lid. The open lever is removable from the lid.

Effects of the Invention

According to an aspect of the present invention, it is possible to reduce the cost of a printer in which recording paper is loadable.

Furthermore, according to an aspect of the present invention, it is possible to easily open a lid even with recording paper being stuck between a fixed blade and a movable blade slid toward the fixed blade in a printer.

EMBODIMENT(S) OF THE INVENTION

Figure 1:
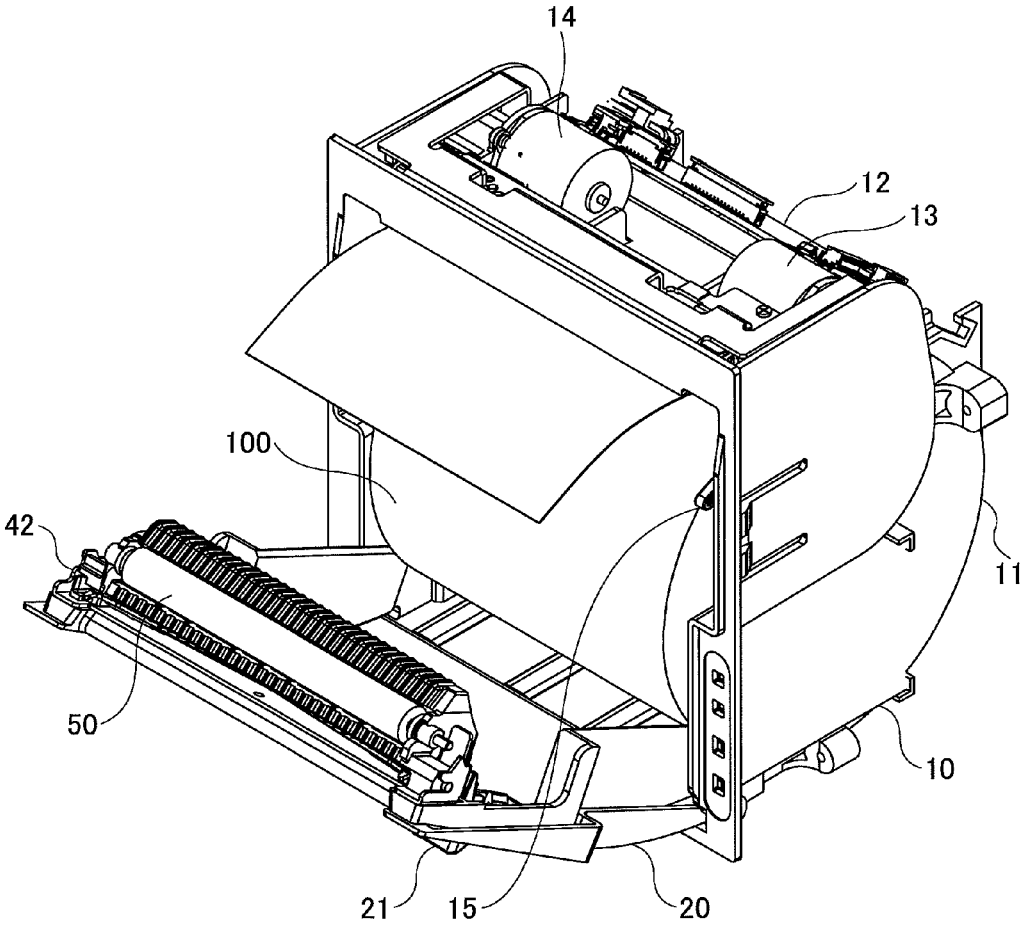
FIG. 1 is a perspective view of a printer according to an embodiment with a lid open.

An embodiment of the present invention is described below. The same member or the like is referred to using the same reference numeral, and a repetitive description thereof is omitted.

Figure 2:
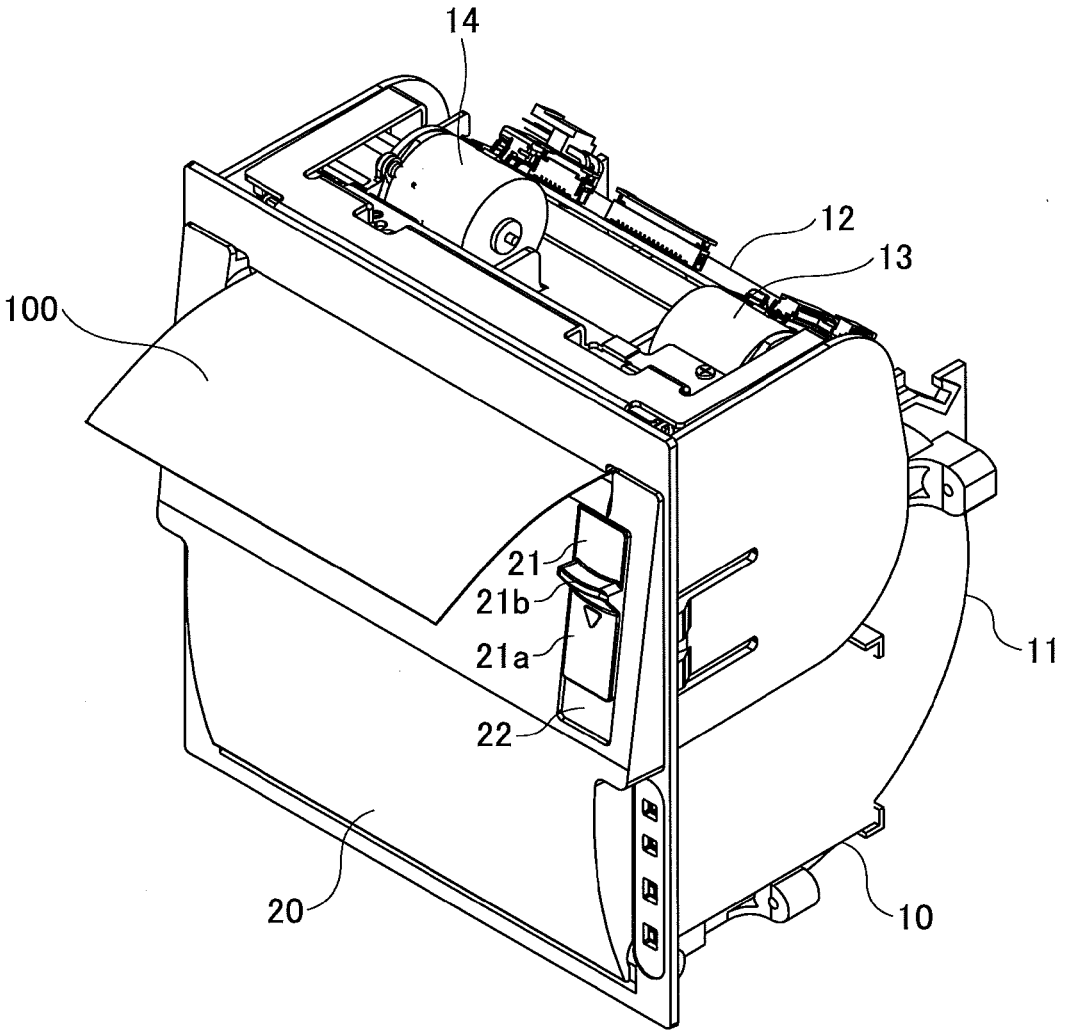
FIG. 2 is a perspective view of the printer according to the embodiment with the lid closed.
Figure 3:
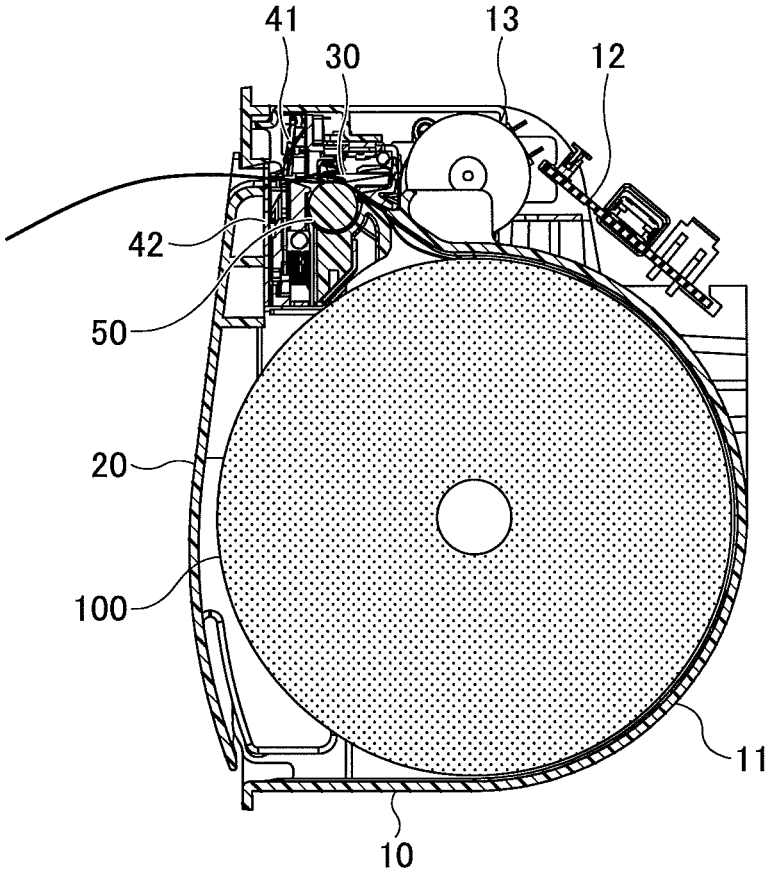
FIG. 3 is a cross-sectional view of the printer according to the embodiment with the lid closed.

A printer according to this embodiment is described with reference to FIGS. 1 through 3. FIG. 1 is a perspective view of the printer with a lid open. FIG. 2 is a perspective view of the printer with the lid closed. FIG. 3 is a cross-sectional view of the printer with the lid closed.

The printer according to this embodiment includes a printer body 10 and a lid 20 attached to the printer body 10. The lid 20 is attached to the printer body 10 to be pivotable about a shaft. In other words, the printer according to this embodiment includes the lid 20 that is attached to the printer body 10 to be openable and closable. The printer body 10 includes a body case (recording paper holder) 11, and a roll of recording paper 100 is loadable in the body case 11. The roll of recording paper 100 used in the printer according to this embodiment is thermal paper.

A control circuit board 12, motors 13 and 14, a thermal head 30, which is a recording head for printing on the recording paper 100, and a fixed blade 41 are provided in the printer body 10. The control circuit board 12 is for controlling the printer. Each of the motors 13 and 14 is for conveying the recording paper 100 or driving a movable blade 42 described below. One of the motors 13 and 14 may be used for conveying the recording paper 100 and the other may be used for driving the movable blade 42.

An open lever 21 for opening the lid 20, the movable blade 42, and a platen roller 50 are provided on the lid 20. The open lever 21 is provided to move upward and downward in a groove 22 provided in a front surface, that is, an exterior surface, of the lid 20.

According to this embodiment, the fixed blade 41 provided in the printer body 10 and the movable blade 42 provided on the lid 20 form a cutter to cut the recording paper 100. The movable blade 42 is moved toward the fixed blade 41 by a motor driving force to cut the recording paper 100 between the fixed blade 41 and the movable blade 42.

Furthermore, the printer body 10 is provided with a lock lever 15 for detaching the platen roller 50 pressed against the thermal head 30. By pressing the lock lever 15 downward, the platen roller 50 is separated from the thermal head 30, so that it is possible to disengage the platen roller 50 from the printer body 10. That is, the platen roller 50 is locked by catching a hook 60 formed monolithically with the lock lever 15 on a shaft of the platen roller 50. Furthermore, by pressing the lock lever 15 downward, the hook 60 is lowered to disengage from the shaft of the platen roller 50. As a result, it is possible to detach the platen roller 50 from the printer body 10.

According to the printer of this embodiment, the platen roller 50 is attached to the lid 20. Therefore, by sliding the open lever 21 provided on the lid 20 downward to press the lock lever 15 downward, it is possible to detach the platen roller 50 from the printer body 10 and open the lid 20.

When the platen roller 50 is detached from the printer body 10 by operating the lock lever 15, the platen roller 50 urged by a spring provided in a printer mechanism part is pushed out. Therefore, according to this embodiment, a force due to the spring, that is, a force acting in a direction in which the platen roller 50 is pushed out by the spring, is applied as part of a force to open the lid 20.

In the case of loading the printer according to this embodiment with the recording paper 100, the roll of recording paper 100 is loaded in the body case 11 of the printer body 10, and the lid 20 is closed.

According to an alternative structure of the printer of this embodiment, the platen roller 50 may be provided in the printer body 10 and the thermal head 30 may be provided on the lid 20.

Next, a method of opening the lid 20 according to the printer of this embodiment is described. The lid 20 is opened, for example, when the recording paper 100 in the printer body 10 has run out or in the case of replacing the recording paper 100.

Figure 4:
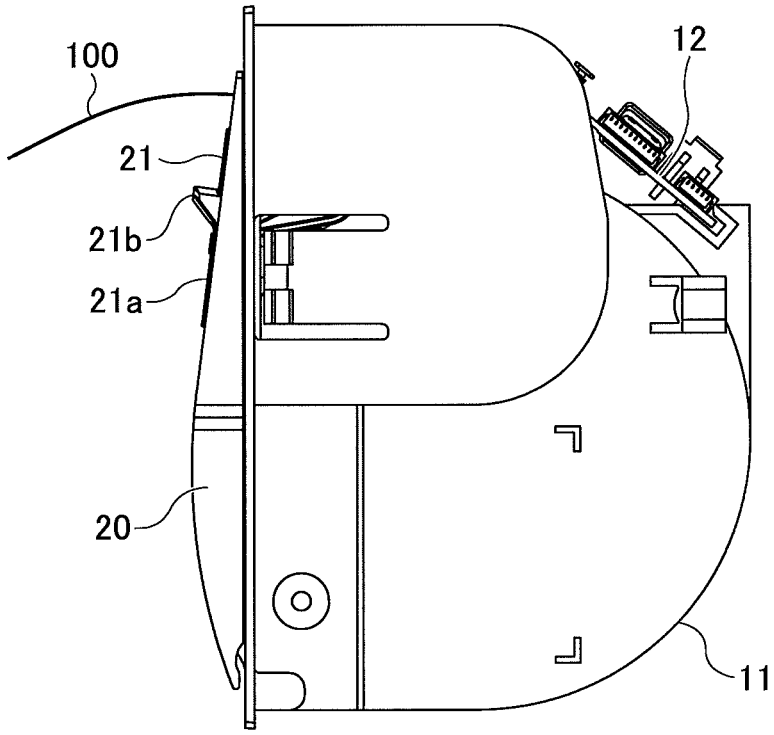
FIG. 4 is a side view of the printer according to the embodiment for illustrating a method of opening the lid.
Figure 5:
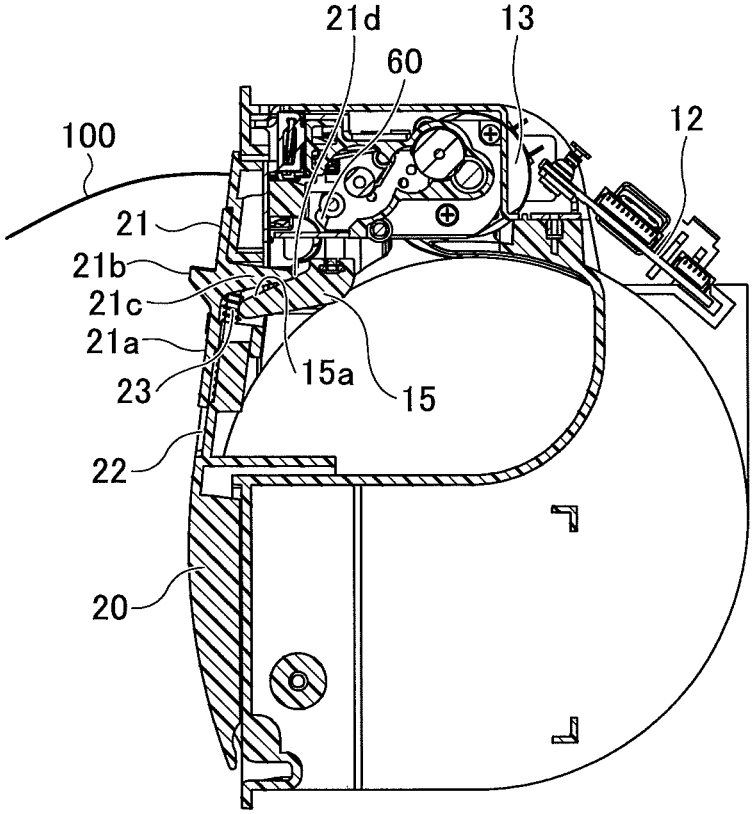
FIG. 5 is a cross-sectional view of the printer according to the embodiment for illustrating the method of opening the lid.

First, the case where the lid 20 is closed is described with reference to FIGS. 2, 4 and 5. FIGS. 4 and 5 are a side view and a cross-sectional view, respectively, of the printer with the lid 20 closed.

The open lever 21 attached to the lid 20 includes a slidable part 21*a* that slides in the groove 22 formed in the front surface, namely, the exterior surface, of the lid 20 along its lengthwise direction, an operation part 21*b* that projects outward from the slidable part 21*a* to be operated by a human finger or the like, and a projection 21*c* that projects inward relative to the lid 20. The projection 21*c* includes an end 21*d* that contacts the lock lever 15. A spring 23 is connected to the open lever 21. The spring 23 is provided to urge the open lever 21 in a direction to return the open lever 21 pressed downward by a human finger or the like upward. Furthermore, a slope 15*a* is formed on part of the lock lever 15 provided in the printer body 10 which part contacts the end 21*d* of the projection 21*c* of the open lever 21. The lock lever 15 is provided in the printer body 10 to be pivotable about an axis of rotation that lies in the direction going into the plane of FIG. 5.

Figure 6:
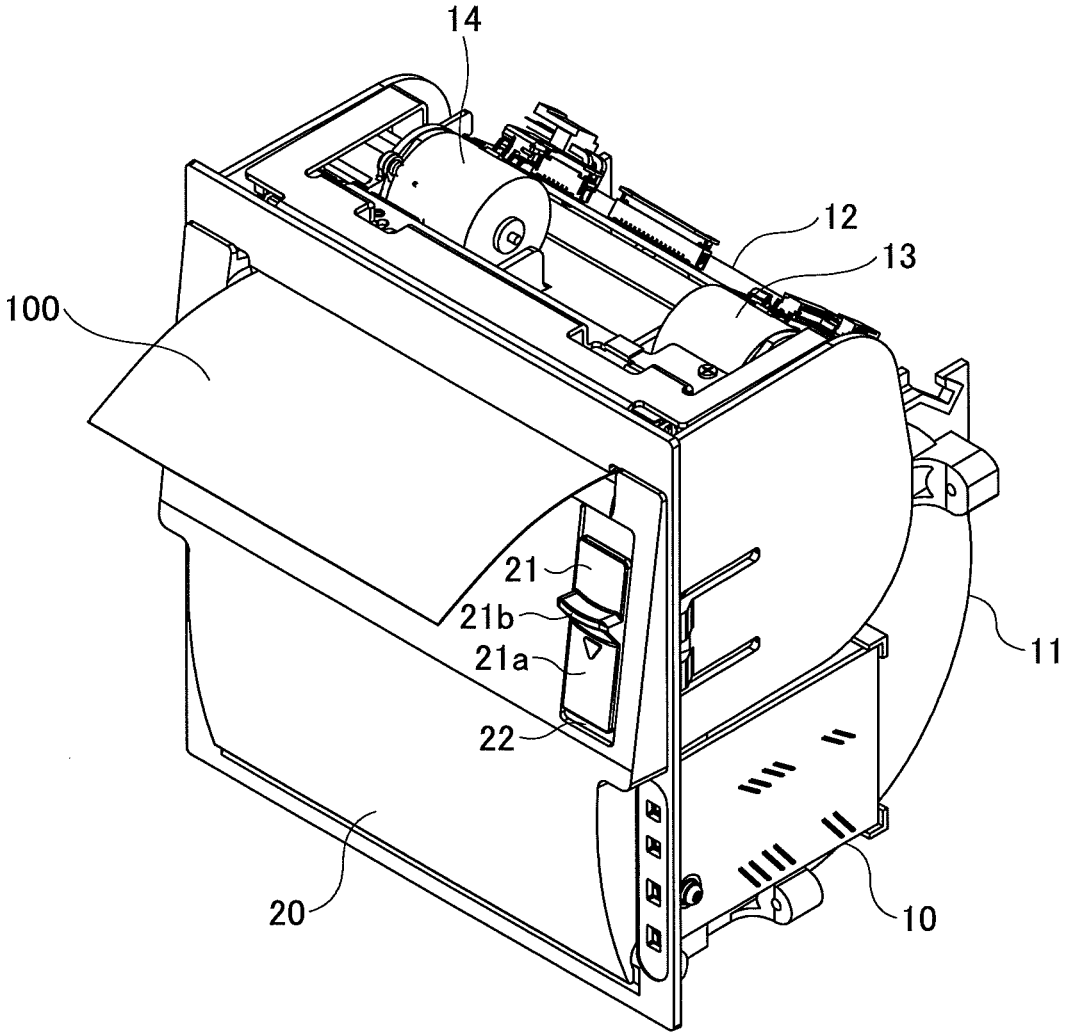
FIG. 6 is a perspective view of the printer according to the embodiment for illustrating the method of opening the lid.
Figure 7:
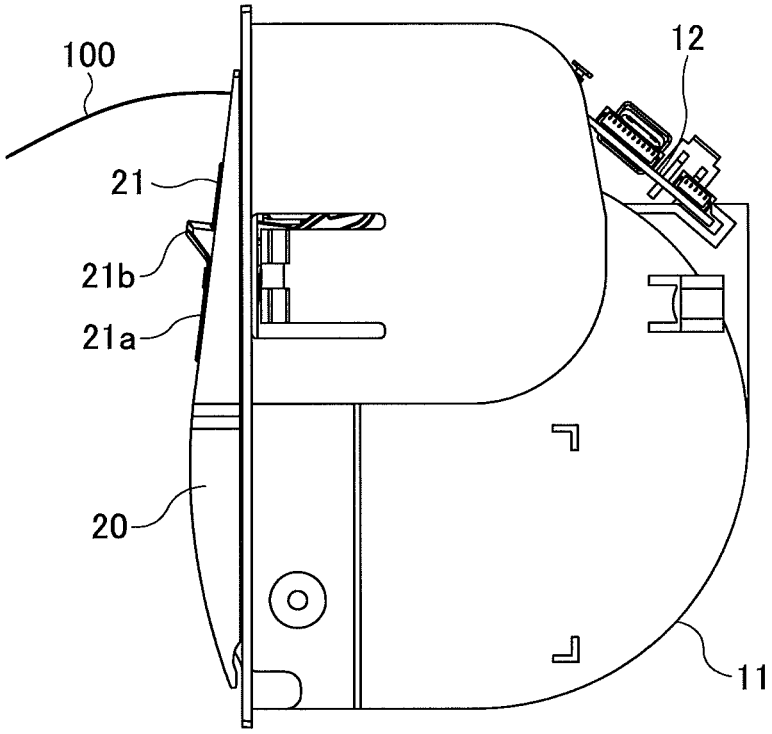
FIG. 7 is a side view of the printer according to the embodiment for illustrating the method of opening the lid.
Figure 8:
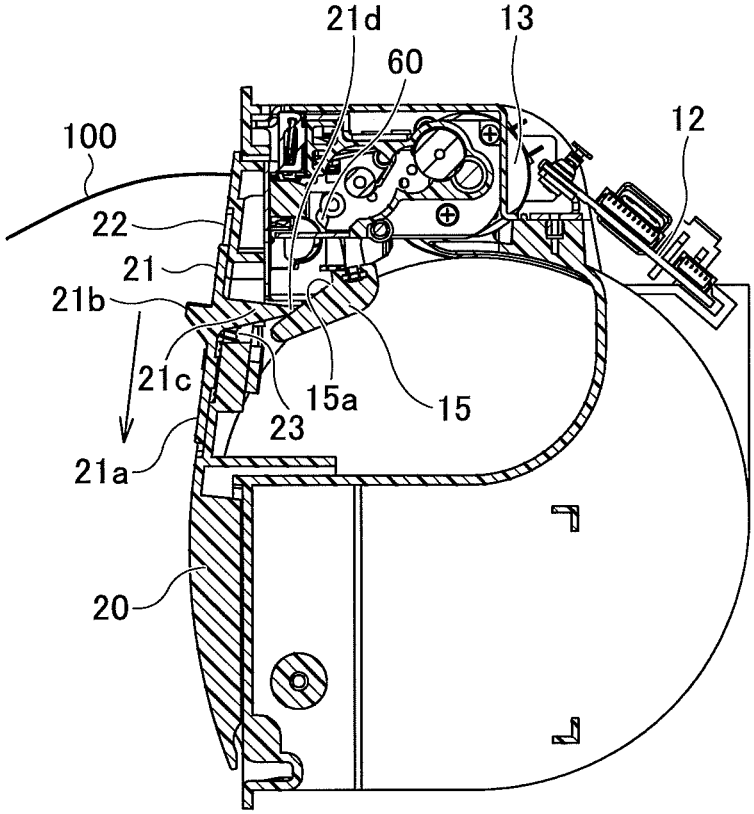
FIG. 8 is a cross-sectional view of the printer according to the embodiment for illustrating the method of opening the lid.

Next, as depicted in FIGS. 6 through 8, a downward force is applied to the operation part 21*b* of the open lever 21 with a human finger of the like to move the slidable part 21*a* downward (in the direction indicated by an arrow in FIG. 8) in the groove 22. FIGS. 6, 7 and 8 are a perspective view, a side view and a cross-sectional view, respectively, of the printer with the slidable part 21*a* moved downward.

As depicted in FIGS. 6 through 8, the open lever 21 is moved downward by a downward movement of the slidable part 21*a* in the groove 22. In accordance with this movement of the open lever 21, the projection 21*c* also moves downward. Therefore, as depicted in FIG. 8, the end 21*d* of the projection 21*c* of the open lever 21 depresses the lock lever 15 while moving along the slope 15*a* of the lock lever 15.

Figure 9:
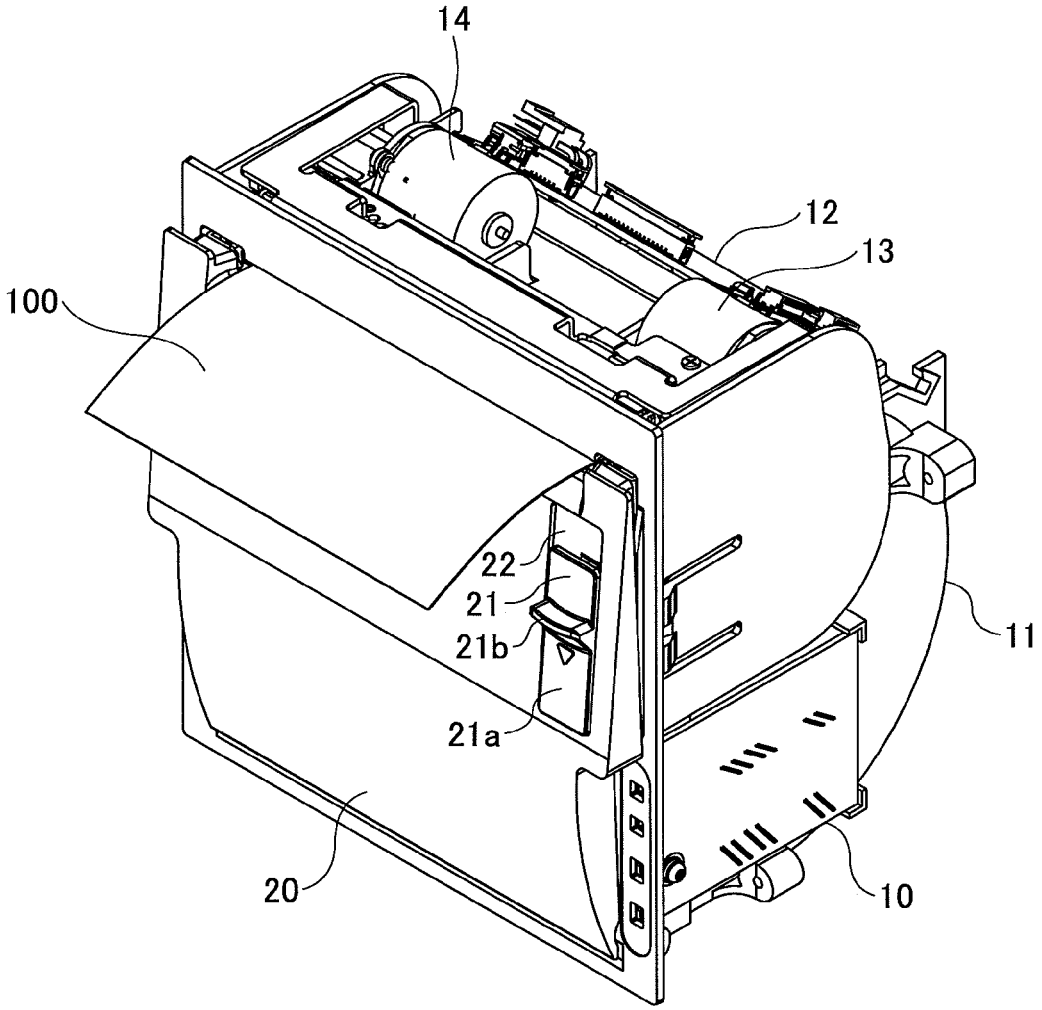
FIG. 9 is a perspective view of the printer according to the embodiment for illustrating the method of opening the lid.
Figure 10:
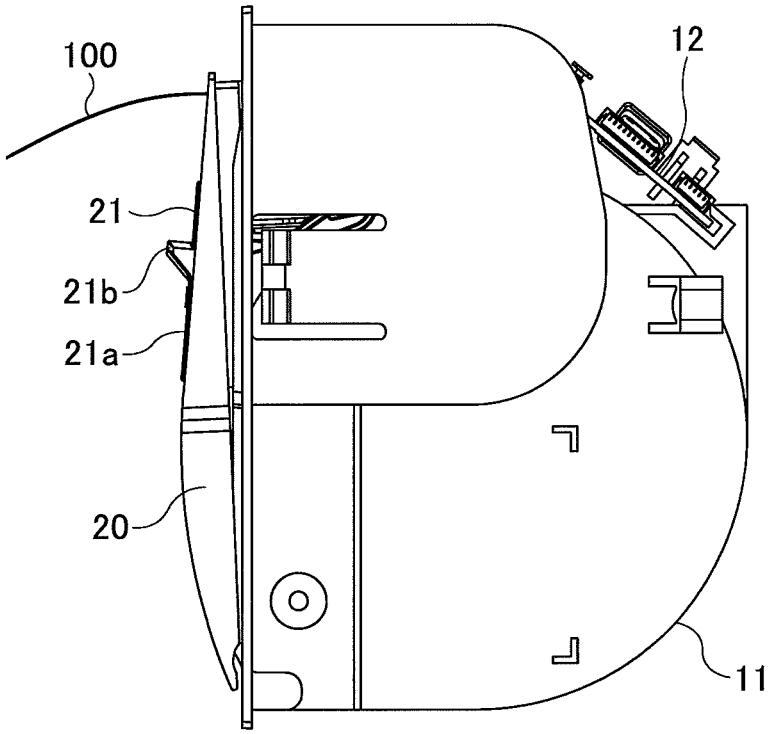
FIG. 10 is a side view of the printer according to the embodiment for illustrating the method of opening the lid.
Figure 11:
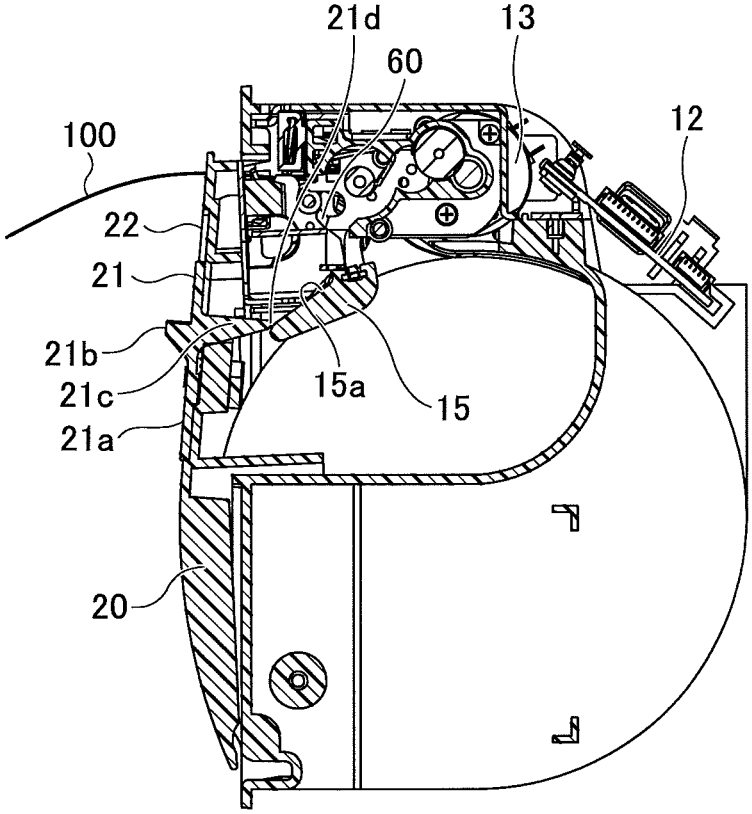
FIG. 11 is a cross-sectional view of the printer according to the embodiment for illustrating the method of opening the lid.

Next, as depicted in FIGS. 9 through 11, a downward force is further applied to the operation part 21*b* of the open lever 21 with a human finger or the like to move the slidable part 21*a* downward from the position depicted in FIGS. 6 through 8. FIGS. 9, 10 and 11 are a perspective view, a side view and a cross-sectional view, respectively, of the printer with the slidable part 21*a* moved further downward.

When the slidable part 21*a* of the open lever 21 moves further downward from the position depicted in FIGS. 6 through 8 in the groove 22, the projection 21*c* also moves downward to cause the end 21*d* of the projection 21*c* to press the lock lever 15 as depicted in FIG. 11. The lock lever 15 is pressed by the end 21*d* to a particular position to unlock the platen roller 50. When pressed to a predetermined position after the platen roller 50 is unlocked, the lock lever 15 does not move further and remains stationary. At this point, because the left end side of the lock lever 15 in FIG. 11 moves downward, the slope 15*a* also inclines to the lower left as depicted FIG. 11. In response to the operation of moving the operation part 21*b* downward, the end 21*d* of the projection 21*c* of the open lever 21 slides downward and outward (leftward in FIG. 11) along the slope 15*a* of the stationary lock lever 15. As a result of this outward movement of the end 21*d* of the projection 21*c* of the open lever 21 along the slope 15*a* of the lock lever 15, a force is applied to the open lever 21 in a direction to open the lid 20, so that the lid 20 pivots about a shaft at the connection to the printer body 10 to open.

According to this embodiment, when the lock lever 15 is depressed to the predetermined position, a force is applied to the platen roller 50 in a direction to move away from the thermal head 30. This force becomes part of a force to open the lid 20.

Figure 12:
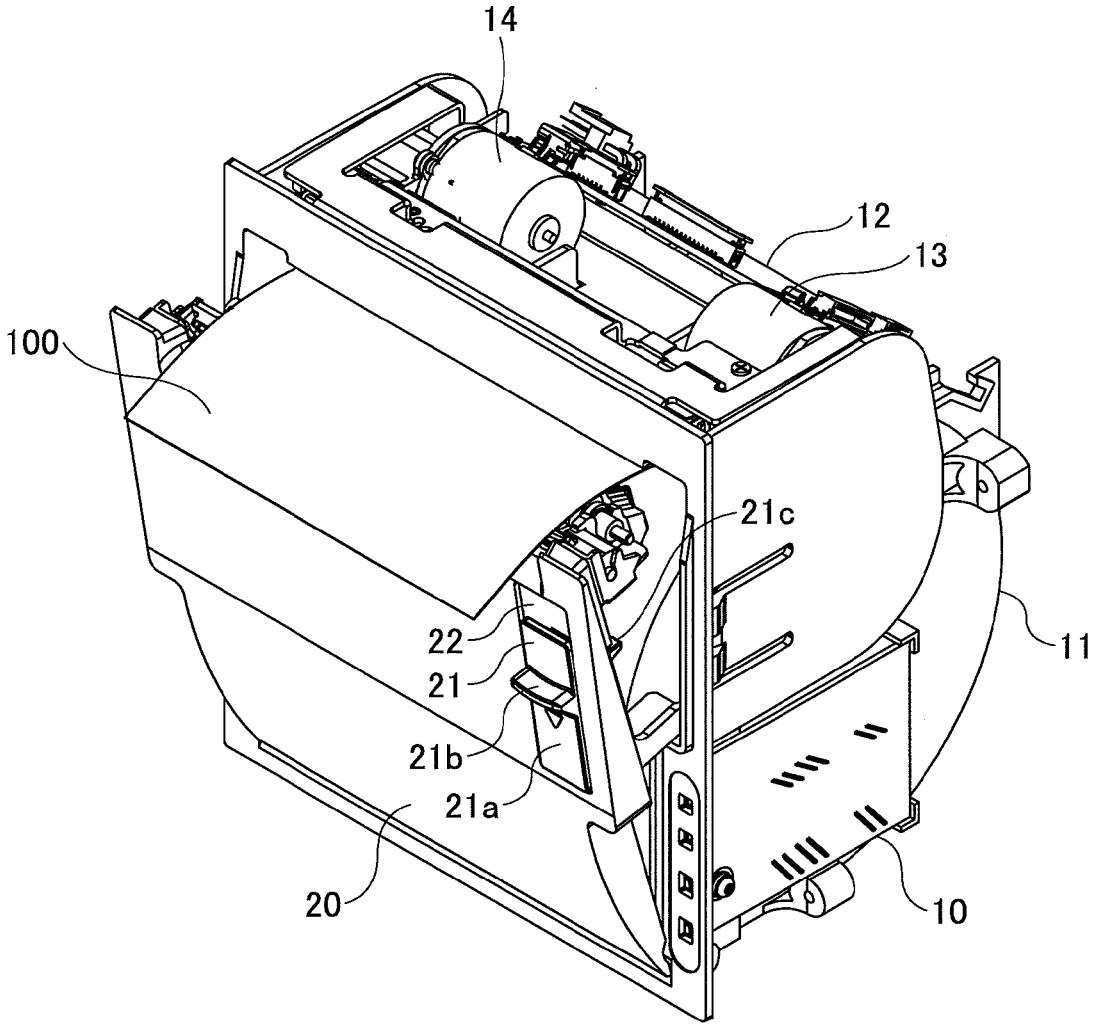
FIG. 12 is a perspective view of the printer according to the embodiment for illustrating the method of opening the lid.
Figure 13:
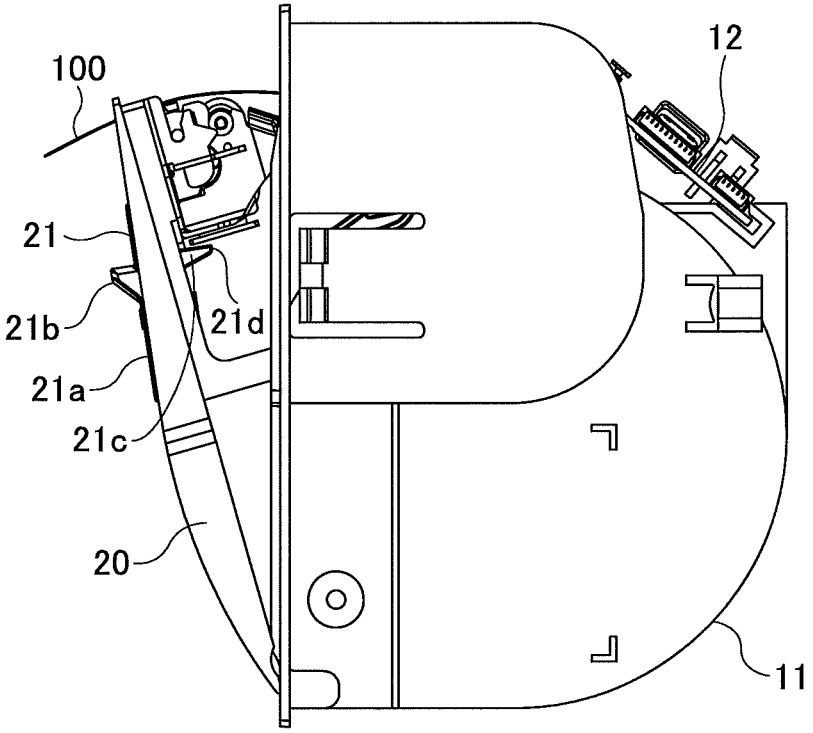
FIG. 13 is a side view of the printer according to the embodiment for illustrating the method of opening the lid.
Figure 14:
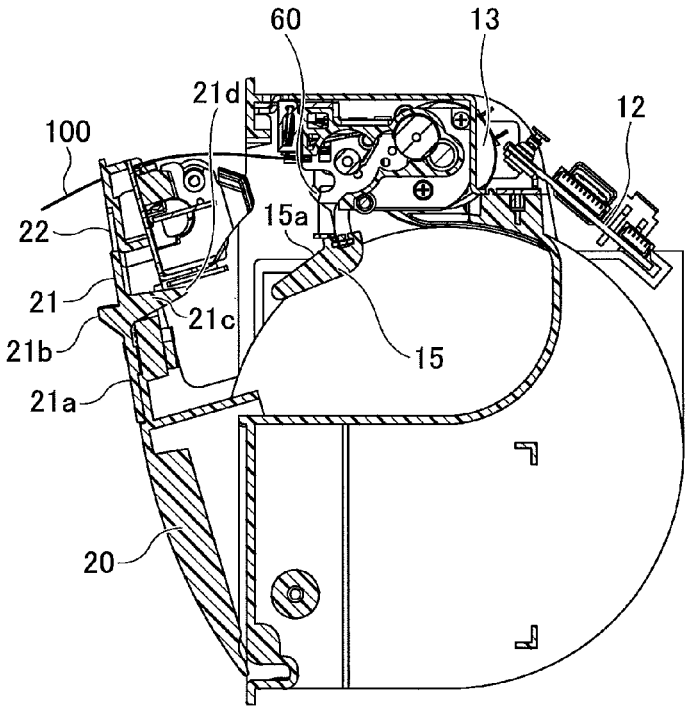
FIG. 14 is a cross-sectional view of the printer according to the embodiment for illustrating the method of opening the lid.

Thereafter, as depicted in FIGS. 12 through 14, the lid 20 opens. FIGS. 12, 13 and 14 are a perspective view, a side view and a cross-sectional view, respectively, of the printer with the lid 20 open.

When the lid 20 opens, the end 21*d* of the projection 21*c* of the open lever 21 is separated from the lock lever 15, so that the lid 20 is completely open. Thereafter, when a human finger or the like is detached from the operation part 21*b* of the open lever 21, the open lever 21 is moved upward by the spring 23 to return to its original state.

According to the printer of this embodiment, it is possible to open the lid 20 by operating the open lever 21 without providing a spring for opening the lid 20 at the connection of the printer body 10 and the lid 20. Thus, because a spring for opening the lid 20 is unnecessary, it is possible to reduce the cost of the printer.

Figure 15:
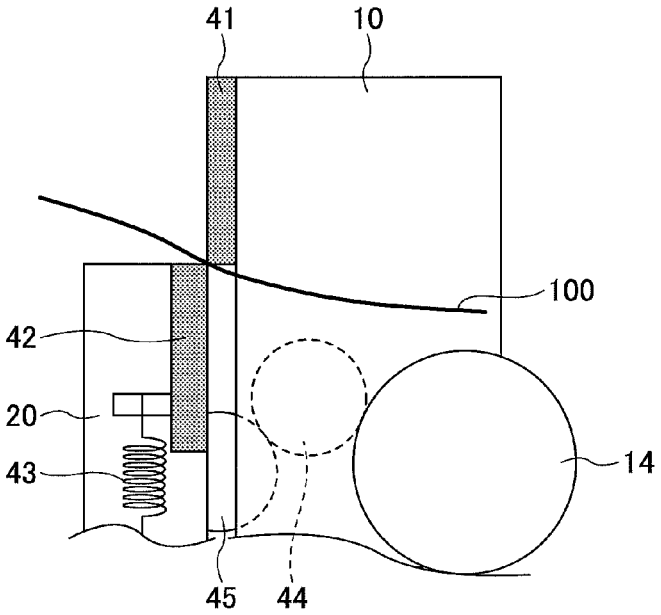
FIG. 15 is a diagram illustrating the cutting of recording paper with a fixed blade and a movable blade.
Figure 16:
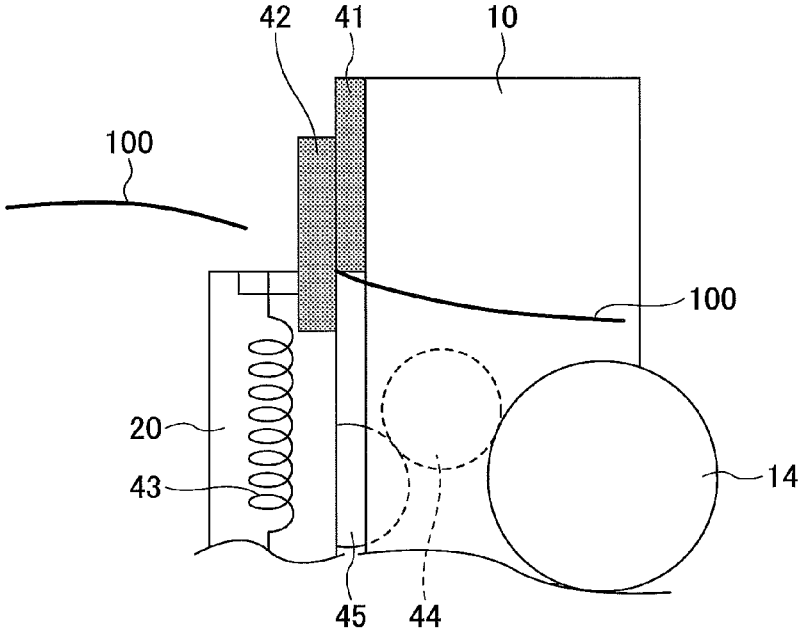
FIG. 16 is a diagram illustrating the cutting of recording paper with the fixed blade and the movable blade.

As described above, at the time of cutting the recording paper 100, the movable blade 42 slides toward the fixed blade 41. FIGS. 15 through 18 are diagrams illustrating the cutting of recording paper with a fixed blade and a movable blade according to this embodiment. The movable blade 42 is moved via gears 44 and 45 by rotating the motor 14 to slide from the position depicted in FIG. 15 to the position depicted in FIG. 16. By thus sliding the movable blade 42 toward the fixed blade 41, the recording paper 100 is cut by the fixed blade 41 and the movable blade 42. After cutting the recording paper 100, the movable blade 42 moves with the urging force of a movable blade spring 43 connected to the movable blade 42 to return to the original state as depicted in FIG. 15.

Figure 17:
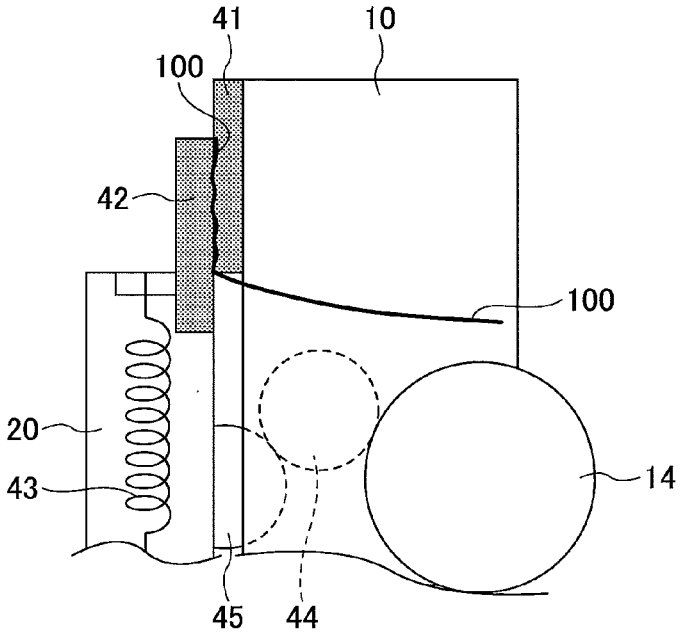
FIG. 17 is a diagram illustrating the cutting of recording paper with the fixed blade and the movable blade.

At the time of cutting the recording paper 100, however, the recording paper 100 may be stuck between the movable blade 42 and the fixed blade 41 as depicted in FIG. 17 to prevent the movable blade 42 from returning with the force of the movable blade spring 43. In this state, because it is not possible to move the lock lever 15 by operating the open lever 21 provided on the lid 20, it is not possible to open the lid 20.

Figure 18:
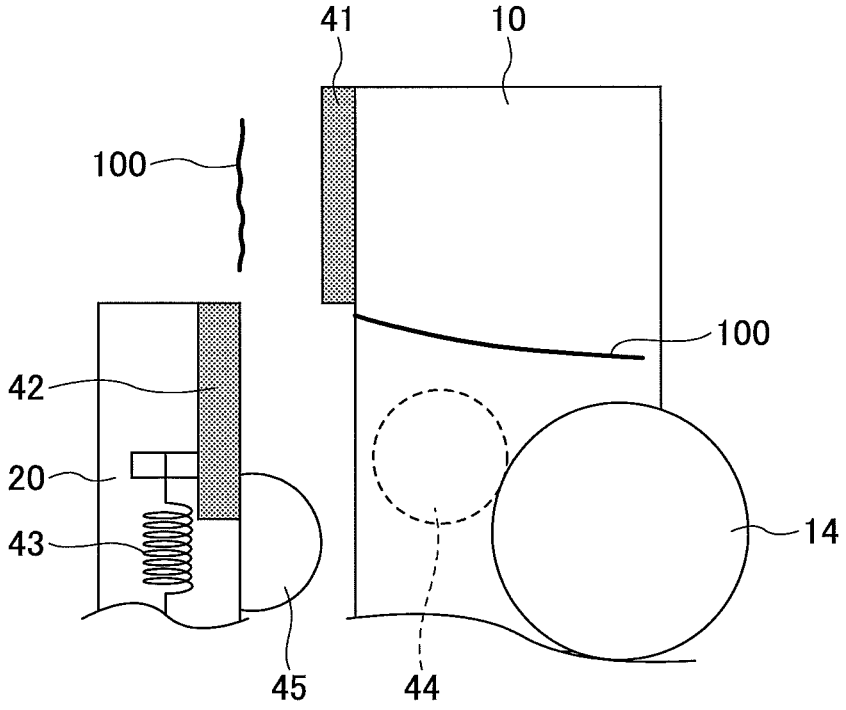
FIG. 18 is a diagram illustrating the cutting of recording paper with the fixed blade and the movable blade.

In the state where the recording paper 100 is stuck between the fixed blade 41 and the movable blade 42 as in FIG. 17, if it is possible to directly operate the lock lever 15, it is possible to separate the platen roller 50 from the printer body 10. As a result, it is possible to return the movable blade 42 to the original state with the movable blade spring 43 by separating the fixed blade 41 and the movable blade 42 and separating the gears 44 and 45 as depicted in FIG. 18. When the lid 20 is closed, however, it is not possible to operate the lock lever 15 inside the lid 20.

Figure 19:
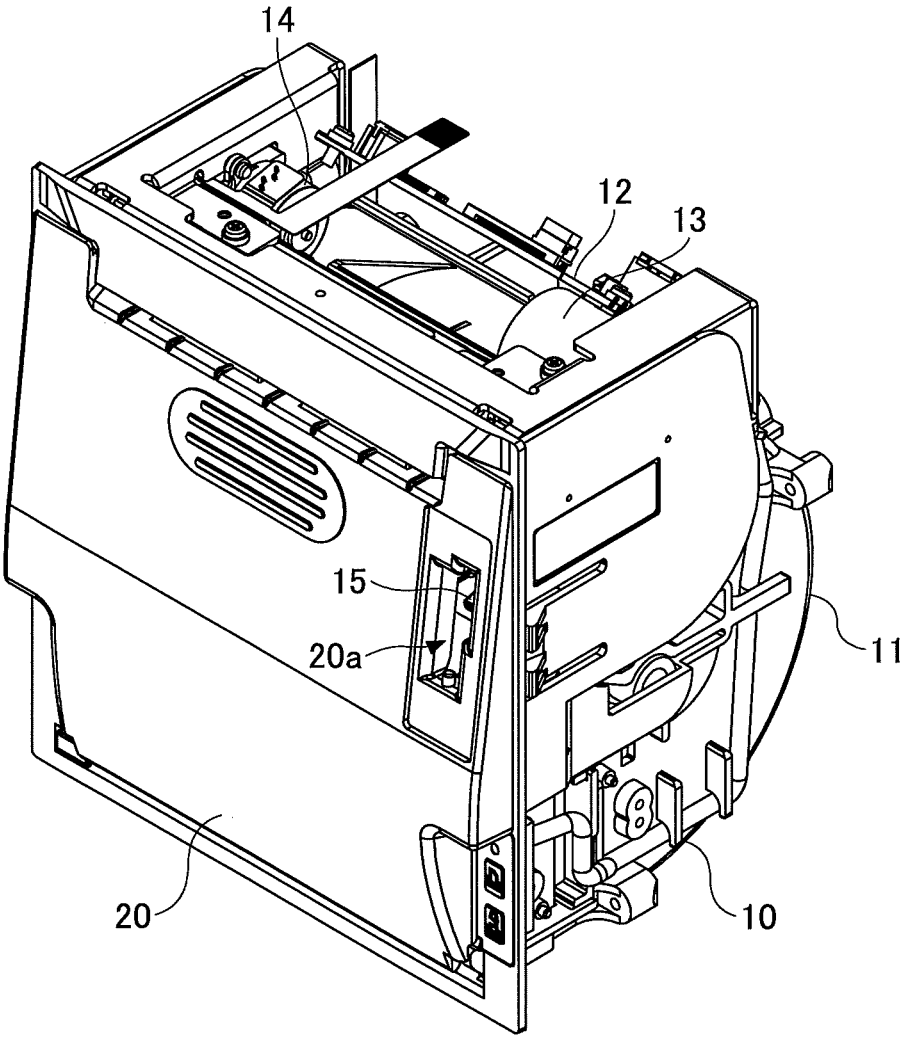
FIG. 19 is a perspective view of the printer according to the embodiment where an open lever is removed and the lid is closed.

A method of opening the lid 20 with the lock lever 15 is described. According to the printer of this embodiment, it is possible to operate the lock lever 15 even when the lid 20 is closed. The open lever 21, which is formed of a deformable material such as a resin material, is removable from the lid 20. FIG. 19 is a perspective view of the printer with the open lever 21 removed from the lid 20 that is closed, illustrating the case where the recording paper 100 is not loaded in the body case 11.

An opening 20*a* is formed in a part of the lid 20 from which the open lever 21 is removed. The lock lever 15 is positioned beyond the opening 20*a* when viewed from outside the lid 20. Therefore, even when the lid 20 is closed, it is possible to disengage the platen roller 50 from the printer body 10 by inserting a driver or the like through the opening 20*a* of the lid 20 and operating the lock lever 15. As a result, the lid 20 opens to separate the fixed blade 41 and the movable blade 42, so that it is possible to return the movable blade 42 to the original position with the movable blade spring 43.

The above-described process is described in more detail with reference to FIGS. 20 through 24. FIG. 21 and the subsequent drawings may be different in details in part from, for example, FIGS. 1 through 14 and 20 for convenience of depiction, but such differences do not affect the configuration of this embodiment.

Figure 20:
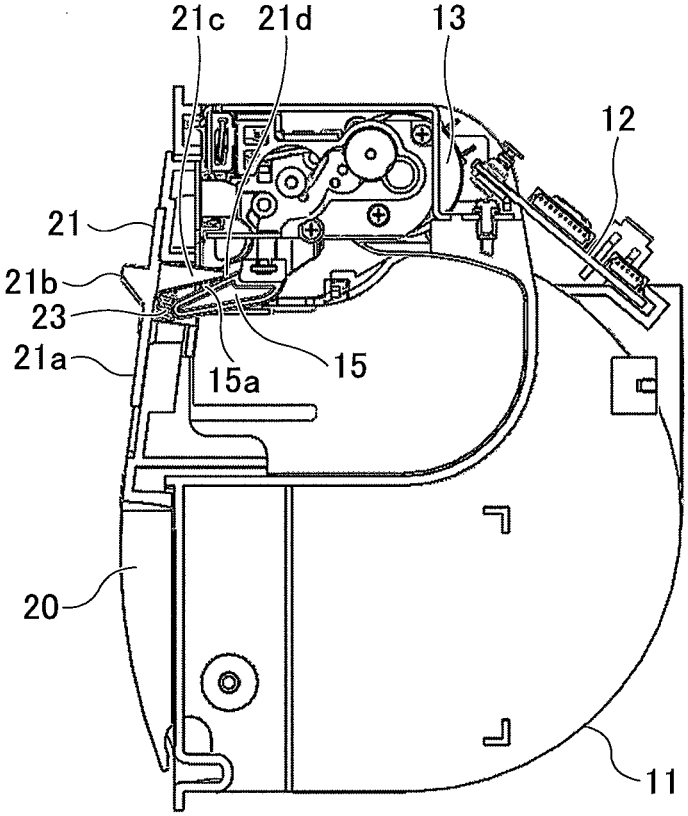
FIG. 20 is a diagram illustrating a method of opening and closing the lid of the printer according to the embodiment, depicting a state before removal of the open lever from the printer.
Figure 21:
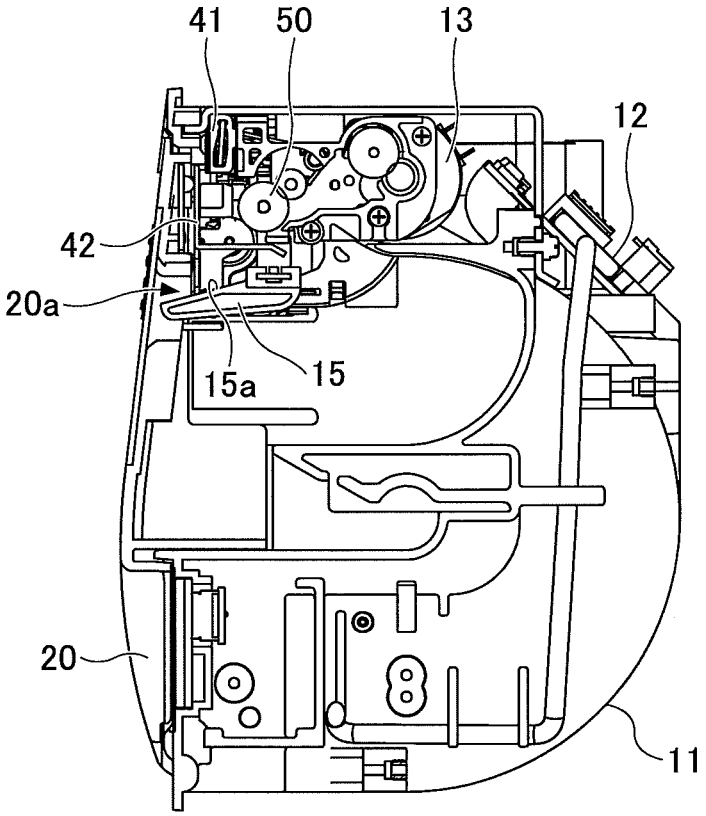
FIG. 21 is a diagram illustrating the method of opening and closing the lid of the printer according to the embodiment from which the open lever is removed.

First, the open lever 21 attached to the lid 20 as depicted in FIG. 20 is removed from the lid 20 as depicted in FIG. 21. As a result, the opening 20*a* is left behind in a part of the lid 20 in which the open lever 21 has been provided, so that the lock lever 15 is exposed through the opening 20*a*. The removed open lever 21 is described in detail below.

Figure 22:
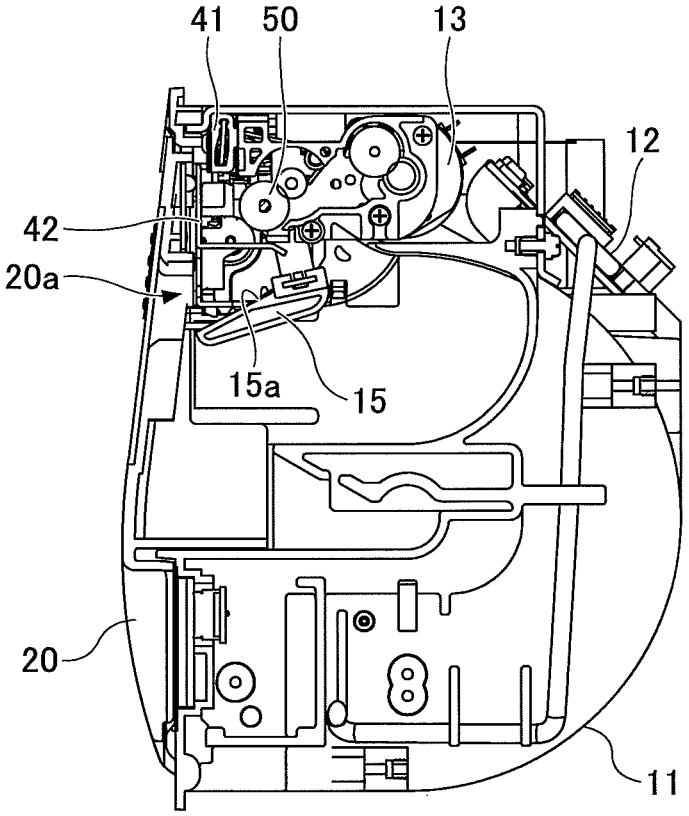
FIG. 22 is a diagram illustrating the method of opening and closing the lid of the printer according to the embodiment from which the open lever is removed.
Figure 23:
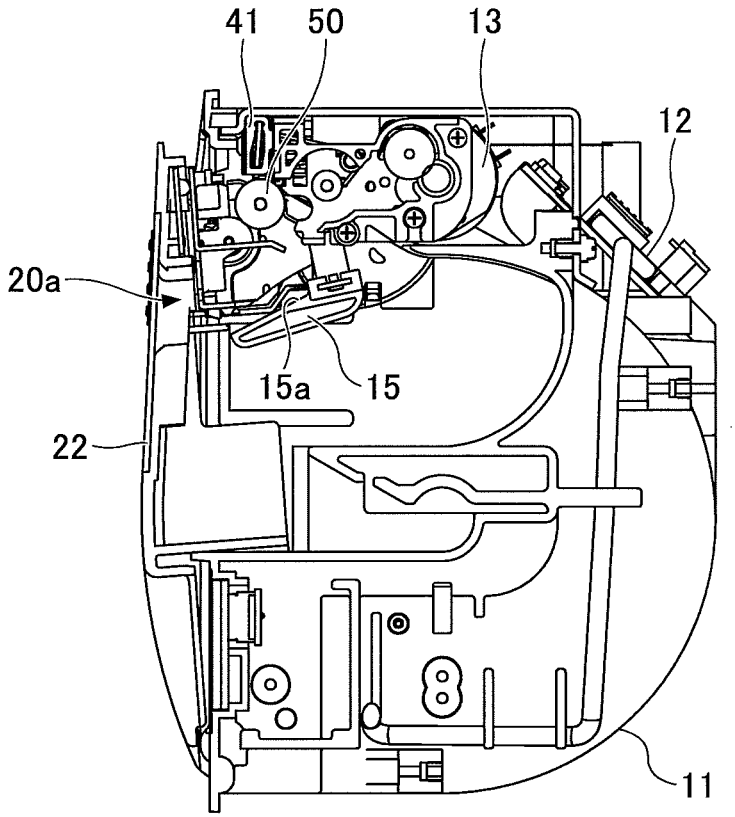
FIG. 23 is a diagram illustrating the method of opening and closing the lid of the printer according to the embodiment from which the open lever is removed.

Next, a tool such as a driver is inserted through the opening 20*a* to press the lock lever 15 downward as depicted in FIG. 22. In FIG. 22, a tool is not depicted. As a result, the platen roller 50 is disengaged to slightly open the lid 20 as depicted in FIG. 23. The lid 20 thus slightly opens to release the recording paper 100 stuck between the fixed blade 41 and the movable blade 42, so that the movable blade 42 is moved by the movable blade spring 43 to return to the original state.

Figure 24:
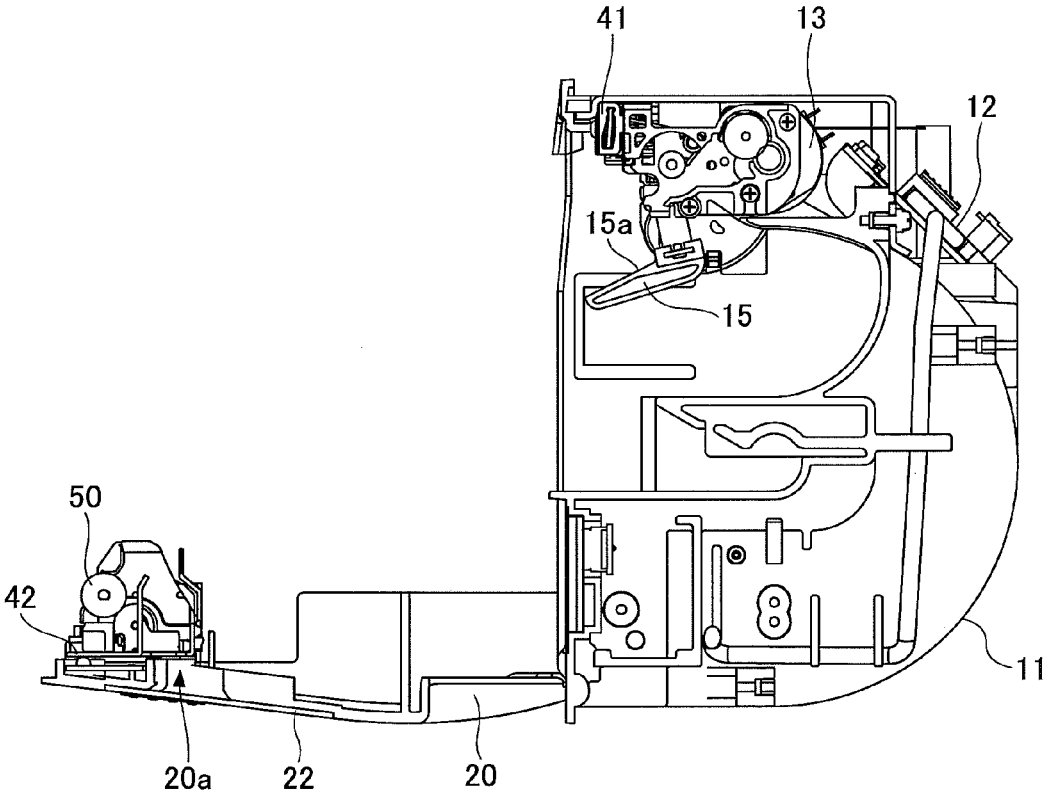
FIG. 24 is a diagram illustrating the method of opening and closing the lid of the printer according to the embodiment from which the open lever is removed.

As a result of the disengagement of the platen roller 50, it is possible to further open the lid 20 into the state as depicted in FIG. 24, where the lid 20 is completely open.

Figure 25:
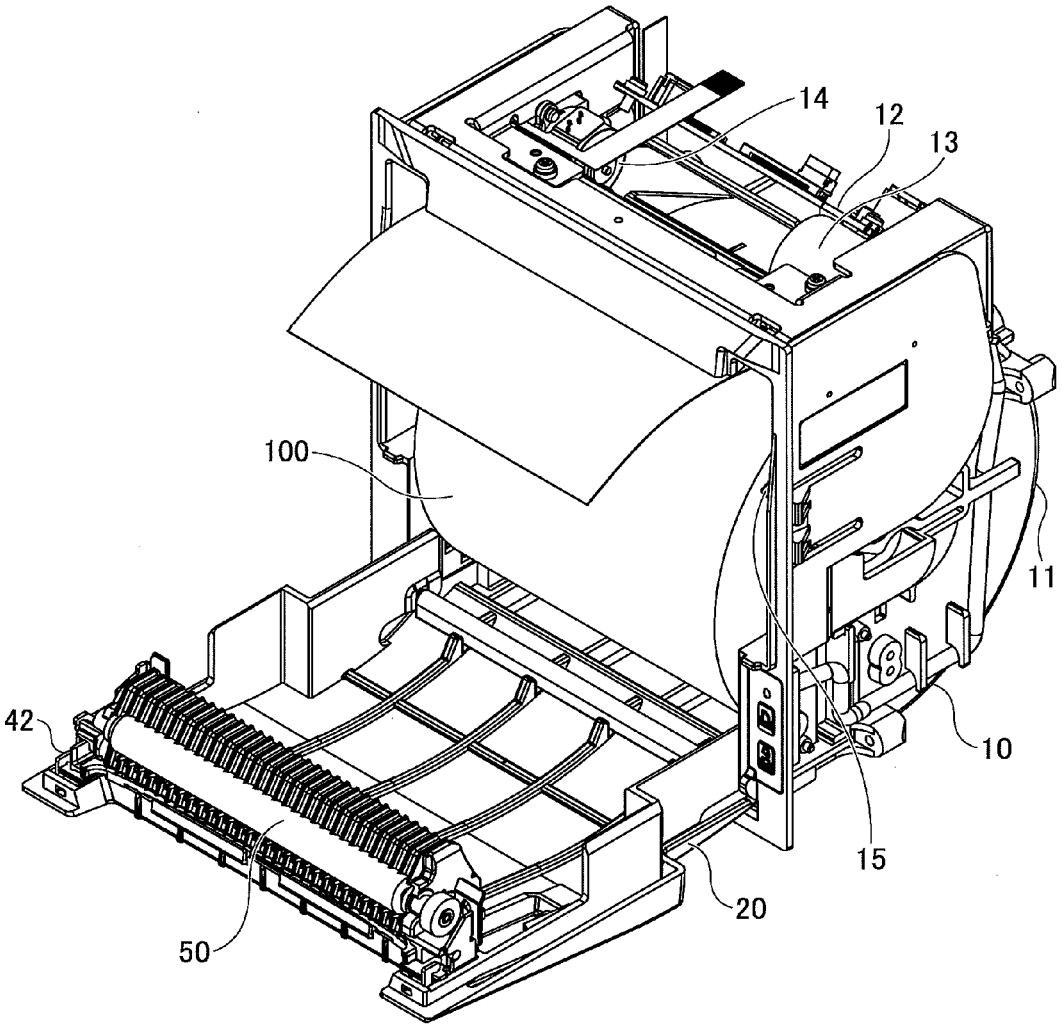
FIG. 25 is a perspective view of the printer according to the embodiment with the open lever removed and the lid open.

FIG. 25 is a perspective view of the printer with the open lever 21 removed and the lid 20 completely open, illustrating the case where the recording paper 100 is loaded in the body case 11.

Figure 26:
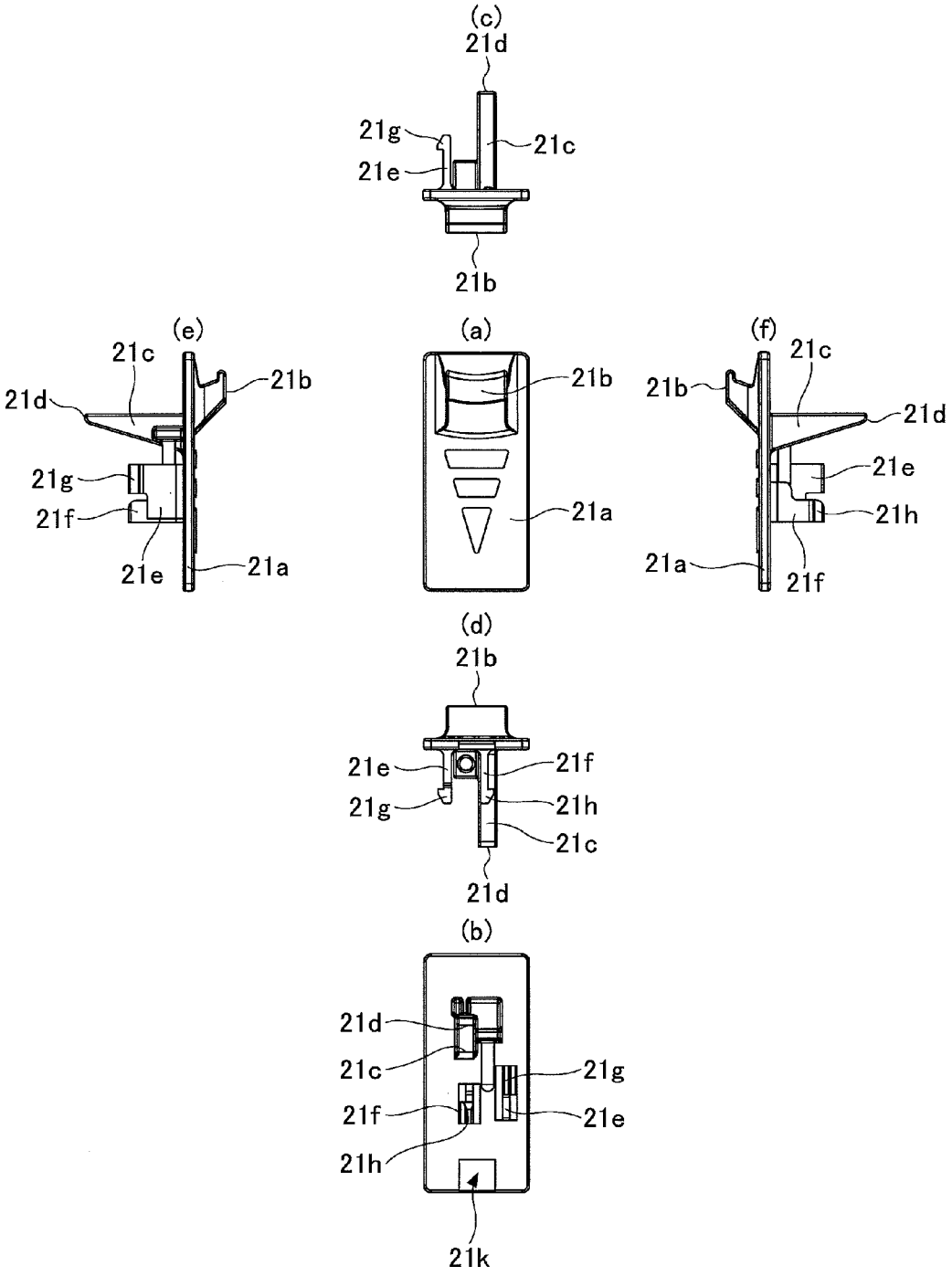
FIG. 26 is a diagram illustrating a structure of the open lever according to the embodiment.
Figure 27:
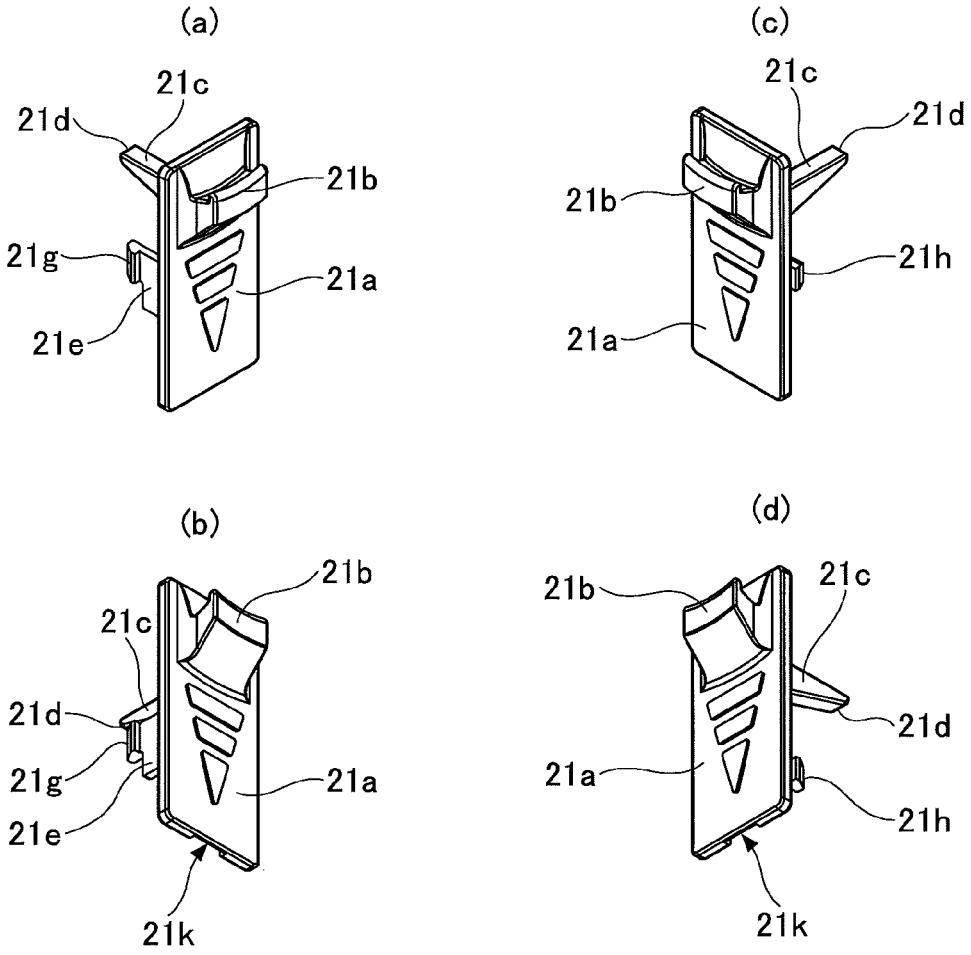
FIG. 27 illustrates perspective views of the open lever according to the embodiment.
Figure 28:
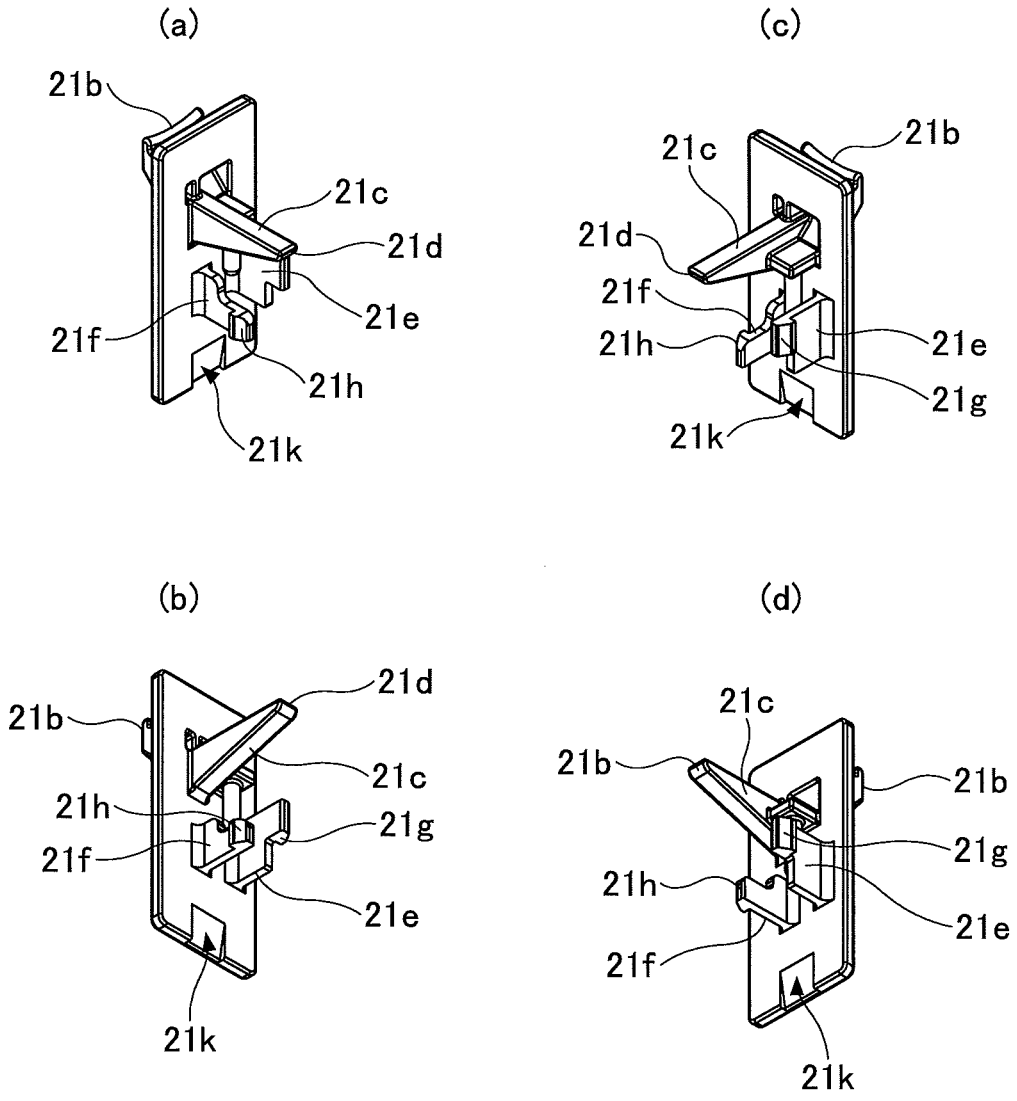
FIG. 28 illustrates perspective views of the open lever according to the embodiment.

Next, the open lever 21 is described with reference to FIGS. 26 through 28. FIGS. 26(*a*), 26(*b*), 26(*c*), 26(*d*), 26(*e*) and 26(*f*) are a front view, a rear view, a plan view, a bottom view, a left side view and a right side view, respectively, of the open lever 21. FIGS. 27(*a*), 27 (*b*), 27 (*c*) and 27 (*d*) are front-side perspective views of the open lever 21 taken from upper left, lower left, upper right, and lower right, respectively. FIGS. 28(*a*), 28(*b*), 28(*c*) and 28(*d*) are rear-side perspective views of the open lever 21 taken from upper left, lower left, upper right, and lower right, respectively.

The open lever 21 has the slidable part 21*a* and the operation part 21*b* provided on the front side and has the projection 21*c* including the end 21*d* provided on the rear side. Furthermore, two thin plate-shaped connection parts 21*e* and 21*f* are provided on the open lever 21 on its rear side to extend in a direction substantially perpendicular to a rear surface of the open lever 21 in order to provide the open lever 21 on the lid 20. The open lever 21 is attached to the lid 20 by inserting the two connection parts 21*e* and 21*f* into the opening 20*a* of the lid 20. To prevent removal of the open lever 21 from the lid 20 when the open lever 21 is operated, a connection projection 21*g* is provided at an end of the connection part 21*e*, and a connection projection 21*h* is provided at an end of the connection part 21*f*.

Figure 29:
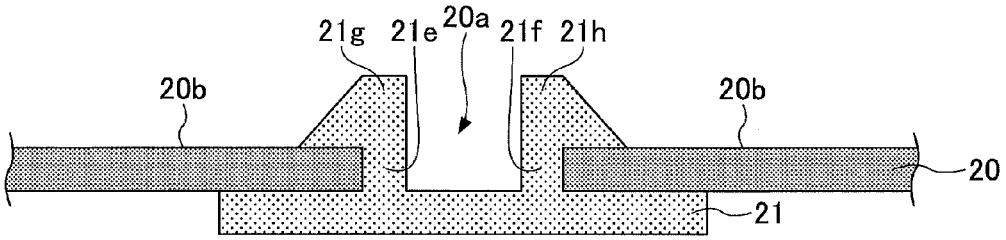
FIG. 29 is a diagram illustrating the open lever according to the embodiment.

FIG. 29 is a diagram illustrating the open lever 21. As depicted in FIG. 29, the connection projections 21*g* and 21*h* are shaped to project outward from each other. When the connection parts 21*e* and 21*f* are inserted into the opening 20*a* of the lid 20, the connection projections 21*g* and 21*h* move inside the lid 20. As a result, the connection projections 21*g* and 21*h* catch an interior surface 20*b* of the lid 20 at opposite edges of the opening 20*a*, so that the open lever 21 is attached to the lid 20. The open lever 21 thus attached to the lid 20 is not removed from the lid 20 by being normally operated.

The open lever 21 is formed of a relatively soft resin material or the like, and the two connection parts 21*e* and 21*f*, which are formed into a thin plate shape, are flexible and easy to bend. Therefore, while the open lever 21 is not removed by being normally operated, the open lever 21 can be removed from the lid 20 by applying a strong force to the open lever 21.

Figure 30:
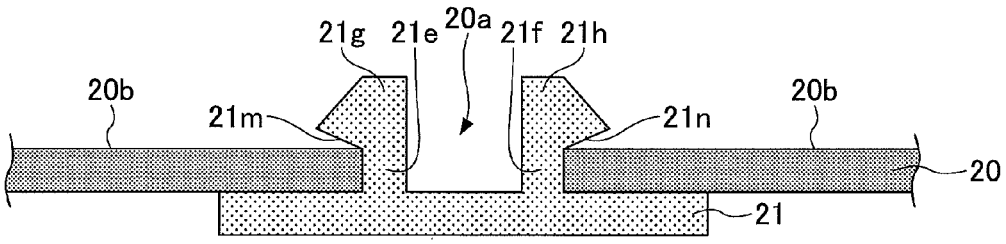
FIG. 30 is a diagram illustrating the open lever according to the embodiment.

Furthermore, to facilitate removal of the open lever 21 from the lid 20, a projection slope 21*m* may be formed on a part of the connection projection 21*g* that faces the interior surface 20*b* of the lid 20, and a projection slope 21*n* may be formed on a part of the connection projection 21*h* that faces the interior surface 20*b* of the lid 20 as depicted in FIG. 30. The projection slope 21*m* is formed to gradually increase the interval between the interior surface 20*b* and the connection projection 21*g* as moving away from the opening 20*a* in the leftward direction of the drawing. Likewise, the projection slope 21*n* is formed to gradually increase the interval between the interior surface 20*b* and the connection projection 21*h* as moving away from the opening 20*a* in the rightward direction of the drawing. Accordingly, at the time of removing the open lever 21 from the lid 20, the projection slope 21*m* of the connection projection 21*g* and the projection slope 21*n* of the connection projection 21*h* contact the opposite edges of the opening 20*a* during the removal. At this point, the connection parts 21*e* and 21*f* flex to gradually reduce their interval. Therefore, it is possible to easily remove the open lever 21 from the lid 20.

Figure 31:
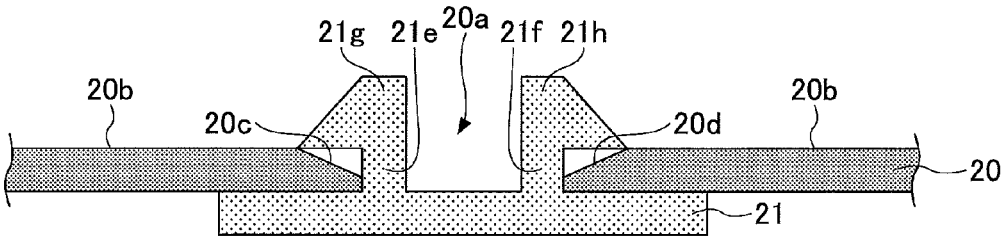
FIG. 31 is a diagram illustrating the open lever according to the embodiment.

Furthermore, to facilitate removal of the open lever 21 from the lid 20, a lid interior slope 20*c* may be formed on a part of the interior surface 20*b* of the lid 20 that faces the connection projection 21*g* of the open lever 21, and a lid interior slope 20*d* may be formed on a part of the interior surface 20*b* of the lid 20 that faces the connection projection 21*h* of the open lever 21, as depicted in FIG. 31. The lid interior slope 20*c* is formed to gradually increase the interval between the interior surface 20*b* and the connection projection 21*g* as approaching the edge of the opening 20*a*. Likewise, the lid interior slope 20*d* is formed to gradually increase the interval between the interior surface 20*b* and the connection projection 21*h* as approaching the edge of the opening 20*a*. Accordingly, at the time of removing the open lever 21 from the lid 20, the connection projections 21*g* and 21*h* of the open lever 21 contact the lid interior slopes 20*c* and 20*d*, respectively, of the lid 20 during the removal. At this point, the connection parts 21*e* and 21*f* flex to gradually reduce their interval. Therefore, it is possible to easily remove the open lever 21 from the lid 20.

Furthermore, according to this embodiment, to facilitate removal of the open lever 21 from the lid 20, a recess 21*k* is formed in the rear surface of the open lever 21 as depicted in FIGS. 26(*b*), 27(*b*), 27 (*d*) and 28. When the open lever 21 is attached to the lid 20, the recess 21*k* formed in the rear surface of the open lever 21 forms a gap between the lid 20 and the open lever 21. By inserting a pointed tool into this gap, it is possible to easily remove the open lever 21 from the lid 20.

It is possible to reattach the removed open lever 21 to the lid 20 by inserting the connection projection 21*g* of the connection part 21*e* and the connection projection 21*h* of the connection part 21*f* formed on the rear surface of the open lever 21 into the opening 20*a* of the lid 20.

Figure 32:
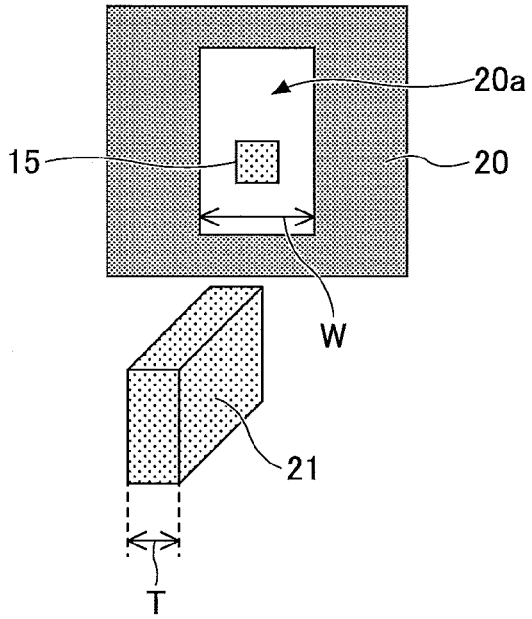
FIG. 32 is a diagram illustrating a method of operating a lock lever using the open lever according to the embodiment.
Figure 33:
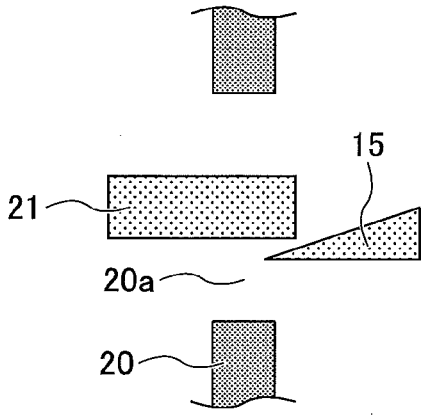
FIG. 33 is a diagram illustrating the method of operating the lock lever using the open lever according to the embodiment.

Furthermore, when a thickness T of the slidable part 21*a* of the open lever 21 is smaller than a width W of the opening 20*a* of the lid 20 as depicted in FIG. 32, it is possible to operate the lock lever 15 by inserting the open lever 21 into the opening 20*a*. Specifically, as depicted in FIG. 33, the lock lever 15 exposed through the opening 20*a* may be operated with the open lever 21 by inserting the open lever 21 in place of a tool into the opening 20*a* from which the open lever 21 is removed.

A printer is described above based on an embodiment. The present invention, however, is not limited to the specifically disclosed embodiment, and variations and modifications may be made without departing from the scope of the present invention.

DESCRIPTION OF THE REFERENCE NUMERALS

10 printer body
11 body case (recording paper holder)
12 control circuit board
13 motor
14 motor
15 lock lever
15*a* slope
20 lid
20*a* opening
20*b* interior surface of the lid
20*c* lid interior slope
20*d* lid interior slope
21 open lever
21*a* slidable part
21*b* operation part
21*c* projection
21*d* end
21*e* connection part
21*f* connection part
21*g* connection projection
21*h* connection projection
21*k* recess
21*m* projection slope
21*n* projection slope
30 thermal head
41 fixed blade
42 movable blade
50 platen roller
60 hook

The invention claimed is:

1. A printer, comprising:
a printer body;
a lid attached to the printer body to be opened and closed;
a lock configured to lock a platen roller attached to one of the printer body and the lid;
a lock lever configured to unlock the locked platen roller; and
an open lever slidably provided on the lid, the open lever including a projection,
wherein a surface of the lock lever that contacts the projection is sloped in a direction in which the lid is configured to be opened, and
the open lever is configured to slide to press the sloped surface of the lock lever with the projection to open the lid.

2. The printer as claimed in claim 1, further comprising:
a spring configured to urge the open lever in a direction for the open lever to return to an original state.

3. A printer, comprising:
a printer body;
a lid attached to the printer body to be opened and closed;
a lock lever provided in the printer body and configured to separate a platen roller and a recording head, wherein the platen roller is attached to the lid with the recording head attached to the printer body or the platen roller is attached to the printer body with the recording head attached to the lid; and
an open lever slidably attached to the lid and configured to slide to operate the lock lever,
wherein the open lever is removably attached to an opening formed in the lid, and
the lock lever is exposed through the opening from which the open lever is removed.

4. The printer as claimed in claim 3, wherein
the open lever includes a plurality of connection parts inserted into the opening and a plurality of connection projections each provided at an end of one of the connection parts, and
each of the connection projections contacts an interior edge of the opening with the open lever being attached to the lid.

5. The printer as claimed in claim 4, wherein a projection slope is formed on each of the connection projections to increase an interval between said each of the connection projections and an interior surface of the lid in a direction away from the opening.

6. The printer as claimed in claim 4, wherein a lid interior slope is formed on each of parts of an interior surface of the lid that face the connection projections to increase an interval between each of the connection projections and the interior surface of the lid toward the opening.

7. A printer, comprising:
a printer body;
a lid attached to the printer body to be opened and closed;
a lock lever configured to lock the lid to the printer body; and
an open lever slidably attached to the lid and configured to slide to operate the lock lever to unlock the lid,
wherein the open lever is removably attached to an opening formed in the lid, and
the lock lever is exposed through the opening from which the open lever is removed.

* * * * *